US006243879B1

(12) United States Patent
Lyden

(10) Patent No.: US 6,243,879 B1
(45) **Date of Patent: *Jun. 12, 2001**

(54) ANATOMICAL AND SHOCK ABSORBING ATHLETIC PANTS

(76) Inventor: Robert M. Lyden, 18261 SW. Fallatin Loop, Aloha, OR (US) 97707

( * ) Notice: Subject to any disclaimer, the term of this patent is extended or adjusted under 35 U.S.C. 154(b) by 0 days.

This patent is subject to a terminal disclaimer.

(21) Appl. No.: 09/474,591

(22) Filed: Dec. 29, 1999

(51) Int. Cl.[7] ..... A41B 9/00
(52) U.S. Cl. ..... 2/227; 2/228; 2/238
(58) Field of Search ..... 2/69, 227, 228, 2/238, 79, 400–408, 247–251, 465, 22, 466, 23, 46

(56) References Cited

U.S. PATENT DOCUMENTS

| | | |
|---|---|---|
| D. 98,867 | 3/1936 | Lee . |
| D. 233,633 | 11/1974 | Burkard . |
| D. 238,828 | 2/1976 | Reed . |
| D. 268,454 | 4/1983 | Novo . |
| D. 385,006 | 10/1997 | Sims . |
| D. 387,539 | 12/1997 | Wagner . |
| D. 403,487 | 1/1999 | Crupi et al. . |
| 620,435 | 2/1899 | Fisher . |
| 763,683 | 6/1904 | Magoris . |
| 1,212,805 | 1/1917 | Newman . |
| 1,277,839 | 9/1918 | Birkenfeld . |
| 1,288,673 | 12/1918 | Potterf . |
| 1,662,981 | 3/1928 | Pazowski . |
| 1,737,882 | 12/1929 | Hatch . |
| 1,861,383 | 5/1932 | Ficcio . |
| 1,998,140 | 4/1935 | Loew . |
| 2,034,312 | 3/1936 | Rubin . |
| 2,128,876 | 8/1938 | Boysen . |
| 2,216,897 | 10/1940 | Zoob . |
| 2,232,246 | 2/1941 | Klein . |
| 2,401,457 | 6/1946 | Bryant . |
| 2,408,723 | 10/1946 | Arpin et al. . |
| 2,411,922 | 12/1946 | Keohane . |
| 2,419,867 | 4/1947 | Woodman . |
| 2,623,210 | 12/1952 | Chatfield . |
| 2,652,053 | 9/1953 | Dann . |
| 2,742,647 | 4/1956 | Khalil . |
| 2,872,685 | 2/1959 | Denbo . |
| 2,983,924 | 5/1961 | Cohen et al. . |
| 3,141,458 | 7/1964 | Burbank . |
| 3,166,764 | 1/1965 | Stedman et al. . |
| 3,169,530 | 2/1965 | Grishman . |
| 3,207,155 | 9/1965 | Casey . |

(List continued on next page.)

FOREIGN PATENT DOCUMENTS

| | | |
|---|---|---|
| 664878 | 4/1988 | (CH) . |
| 89/07896 | 9/1989 | (WO) . |

OTHER PUBLICATIONS

Boxer Style Shorts, #8, p. 539, Sears Spring/Summer 1978 Catalog, GUA 2900 Library.
Allsop/Sims Vibration.
Calvin Klein Sport Brief Package.
Seaquest Catalogue.

*Primary Examiner*—Gloria M. Hale
(74) *Attorney, Agent, or Firm*—Westman, Champlin & Kelly, P.A.

(57) ABSTRACT

The present invention teaches novel athletic pants that permit the male reproductive organs to be substantially suspended naturally, in particular, when used in combination with the novel athletic shorts taught in a co-pending application. The athletic pants include inferior retention means and a superior edge having a V shape, or alternately an arcuate or U shape for facilitating breathing during strenuous exercise on the anterior side. Further, the athletic pants can include means for dampening shock and vibration. In addition, the athletic pants can include a plurality of textile materials for optimizing the internal environment of the athletic pants with respect to temperature, perspiration, wind, and water. Moreover, the athletic pants can include pockets, vents, and vent closure means for selectively controlling the internal environment of the athletic pants.

20 Claims, 7 Drawing Sheets

U.S. PATENT DOCUMENTS

| | | | | |
|---|---|---|---|---|
| 3,517,666 | | 6/1970 | Atlee . | |
| 3,621,846 | | 11/1971 | Lehman . | |
| 3,654,634 | | 4/1972 | Torres . | |
| 3,941,380 | | 3/1976 | LaCoste . | |
| 3,963,022 | | 6/1976 | Rotello . | |
| 4,004,297 | | 1/1977 | Polack . | |
| 4,009,495 | | 3/1977 | Faust . | |
| 4,173,976 | | 11/1979 | Bloomquist et al. . | |
| 4,223,408 | | 9/1980 | Sullivan . | |
| 4,261,060 | | 4/1981 | Zawacki . | |
| 4,371,989 | | 2/1983 | Polsky . | |
| 4,470,156 | | 9/1984 | Duerbeck et al. . | |
| 4,488,317 | | 12/1984 | Polsky . | |
| 4,494,250 | | 1/1985 | Sheppard et al. | 2/227 |
| 4,523,337 | * | 6/1985 | Leibowitz | 2/227 |
| 4,580,297 | * | 4/1986 | Maejima | 2/22 |
| 4,602,388 | | 7/1986 | Underwood et al. . | |
| 4,619,004 | | 10/1986 | Won . | |
| 4,625,336 | | 12/1986 | Derderian . | |
| 4,669,130 | | 6/1987 | Brown . | |
| 4,670,913 | | 6/1987 | Morell et al. . | |
| 4,702,239 | | 10/1987 | Ichikawa . | |
| 4,870,958 | * | 10/1989 | Webster | 602/67 |
| 4,920,769 | * | 5/1990 | Rickerl | 66/176 |
| 4,972,525 | | 11/1990 | Hwang . | |
| 5,023,957 | | 6/1991 | Harvey . | |
| 5,029,345 | | 7/1991 | Angheluta et al. . | |
| 5,040,245 | | 8/1991 | Staley . | |
| 5,109,546 | | 5/1992 | Dicker . | |
| 5,131,100 | | 7/1992 | Atwater et al. . | |
| 5,144,697 | | 9/1992 | Sandbeck . | |
| 5,152,014 | | 10/1992 | Marx et al. . | |
| 5,157,793 | | 10/1992 | Michels . | |
| 5,237,706 | | 8/1993 | Nalbandian . | |
| 5,243,974 | | 9/1993 | Allen . | |
| 5,275,592 | | 1/1994 | Grizzaffi . | |
| 5,362,046 | | 11/1994 | Sims . | |
| 5,379,462 | * | 1/1995 | Morgan et al. | 2/227 |
| 5,524,298 | | 6/1996 | Plunkett . | |
| 5,547,466 | | 8/1996 | McRoberts et al. . | |
| 5,598,587 | | 2/1997 | Wada . | |
| 5,647,065 | | 7/1997 | Richerson . | |
| 5,822,802 | | 10/1998 | Chou . | |
| 5,870,779 | | 2/1999 | Heron . | |
| 5,875,495 | | 3/1999 | Thrower . | |
| 5,915,536 | | 6/1999 | Alberts et al. . | |
| 6,026,517 | | 2/2000 | Kang . | |
| 6,038,703 | | 3/2000 | Chung . | |
| 6,061,840 | | 5/2000 | Alligator . | |

* cited by examiner

ANATOMICAL AND SHOCK ABSORBING ATHLETIC PANTS

FIELD OF THE INVENTION

The present invention relates to articles of apparel, and in particular to athletic pants.

BACKGROUND OF THE INVENTION

Over the last twenty years athletic shorts have evolved such that they frequently feature a textile outer layer or shell, and include a integral inner liner made of stretchlastic material which may include elastic material surrounding the openings for the legs, thus containing and obscuring the male reproductive organs. This inner liner also exerts force upon the male reproductive organs, that is, the penis and scrotum containing the testes, and both elevates and presses the male reproductive organs against the pubic area of the torso. Prior to the introduction of this type of athletic shorts, men frequently wore separate conventional underwear, boxer shorts, briefs, or jock straps underneath athletic shorts consisting of an outer layer or shell. This made for some redundancy in clothing, and it frequently happened that the outer garment would slide out of position relative to the undergarment resulting in an undesirable aesthetic appearance. Alternately, some men would brave wearing nothing at all under athletic shorts consisting of an outer layer or shell, but this would frequently result in chaffing, discomfort, and could present an offense to modesty, in particular, as the presence of perspiration could cause the outer layer or shell to cling to a wearer's anatomy.

While conventional prior art athletic shorts including an integral inner liner which both elevate and press the male reproductive organs against the pubic area of the torso have solved some problems, they have unfortunately introduced others. Such athletic shorts do not permit the male reproductive organs to be suspended naturally. And it is well known that the degree to which the scrotum descends or elevates is at least partially dependent upon temperature. Elevating and pressing the scrotum and testes against the pubic area of the torso therefore potentially subjects these organs to higher than normal temperatures. This is now known to induce the so-called "Jockey Shorts Effect," and can cause a decrease in the rate and quality of spermatogenesis, that is, sperm production. Research has been conducted on the "Jockey Shorts Effect," e.g., see the following articles:

A. Zorgniotti, et al., "The Effect of Clothing on Scrotal temperature in Normal Men and Patients with Poor Semen," *Urology,* February, 1982; 19(2):176–178.

J. Mulcahy, "Scrotal Hypothermia and the Infertile Man," *Journal of Urology,* September, 1984;132(3):469–470.

R. Mieusset, "Association of Scrotal Hyperthermia with Impaired Spermatogenesis in Infertile Men," *Fertility and Sterility,* December, 1987; 48(6):1006–1011.

G. Brindley, "Deep Scrotal Temperature and the Effect on it of Clothing, Air Temperature, Activity, Posture and Paraplegia," *British Journal of Urology,* February, 1982; 54(1):49–50.

Conventional prior art athletic shorts including an inner liner which elevate and press the male reproductive organs against the pubic area of the torso also decrease heat radiation and dissipation from the body. It is well known that the head, hands, feet, and male reproductive organs are the most vascularized portions of the male body and greatly contribute to heat dissipation.

Further, convention prior art athletic shorts including an inner liner which elevate and press the male reproductive organs against the pubic area of the torso are believed to adversely affect thermoregulation. In this regard, see J. Hales and J. Hutchinson, "Metabolic, Respiratory and Vasomotor Responses to Heating the Scrotum of the Ram," *J. Physiology,* London, 1971, pages 353–375, and D. Ingram and K. Legge, "The Influence of Deep Body And Skin Temperatures on Thermoregulatory Responses to Heating of the Scrotum in Pigs," *J. Physiology,* London, 1972, pages 477–487. The physiology of a pig is considered not far distant from man, thus some of the internal organs of pigs are sometimes transplanted into humans. Ingram found that merely exposing the scrotum of a pig to changing temperatures did indeed induce widespread changes in thermoregulation, such as shunting of blood to the skin, something which is known to have dramatic effects in the context of exercise physiology and athletic performance. The effects of various apparel constructions on heat dissipation and thermoregulation in man can be subjectively determined by weartesting, but also objectively measured and recorded with the use of thermometers and infrared thermography equipment.

In addition, conventional prior art athletic shorts including an inner liner which elevate and press the male reproductive organs against the pubic area of the torso are believed to adversely influence the production and operation of sex hormones and anabolic metabolism with respect to the process of adaptation and acquisition of athletic fitness. Endurance training such as distance running tends to lower testosterone levels, and generally, can suppress anabolic processes and functions within the body. The reasons for this are many, varied, and complex, but the acute cause primarily derives from the biochemistry of exercise as energy stores and electrolytes become depleted and de-hydration takes place. Moreover, demanding exercise is associated with other residual and chronic effects which can influence the operation of the endocrine system, thus shift the balance of the metabolism towards catabolism. For example, see the following articles which relate to this subject:

A. Hackney, et al., "Reproductive Hormonal Profiles of Endurance-Trained and Untrained Males," *Medicine and Science in Sports Exercise,* February, 1988; 20(1):60–65.

J. Arce, "Subclinical Alterations in Hormone and Semen Profile in Athletes," *Fertility and Sterility,* February, 1993; 59(2):398–404.

J. Arce, "Exercise and Male Factor Infertility," *Sports Medicine,* March, 1993; 15(3):146–169.

C. Jensen, et al., "Prospective Study of Hormonal and Semen Profiles in Marathon Runners," *Fertility and Sterility,* December, 1995; 64(6):1189–1196.

A. Bonen, et al., "Pituitary, Ovarian, and Adrenal Hormone Responses to Marathon Running," *International Journal of Sports Medicine,* December, 1987; 8 Supplement 3:161–167.

H. Tanaka, et al., "Persistent Effects of a Marathon Run on the Pituitary-Testicular Axis," *Journal of Endocrinological Investigation,* April, 1986; 9(2):97–101.

M. De Souza, et al., "Gonadal Hormones and Semen Quality in Male Runners. A Volume Threshold Effect of Endurance Training," *International Journal of Sports Medicine,* October, 1994; 15(7): 383–391.

J. Ayers, et al., "Anthropomorphic, Hormonal, and Psychological Correlates of Semen Quality in Endurance-Trained Male Athletes," *Fertility and Sterility,* June, 1985; 43(6): 917–921.

K. Kuoppasalmi, et al., "Plasma Cortisol, Androstenedione, Testosterone and Luteinizing Hormone in Running Exercise of Different Intensities," *Scandanavian Journal of Clinical Laboratory Investigation,* September, 1980; 40(5): 403–409.

A. Urhausen, et al., "Blood Hormones as Markers of Training Stress and Overtraining," *Sports Medicine,* October, 1995; 20(4): 251–276.

Moreover, it can be readily understood that a condition which has the capability of lowering sperm counts or affecting the viability of sperm, such as the "Jockey Shorts Effect," can via biofeedback relationships thereby also influence the body's production of testosterone and function of the endocrine system. Accordingly, the so-called "Jockey Shorts Effect" may then not simply be a matter of lower sperm counts or less viable sperm being produced, rather it is believed that such can have a wider impact upon an individual's metabolism. In this regard, it is believed that a tendency exists for the male metabolism to be shifted in the direction of catabolism to greater degree than would otherwise be the case. By continually altering the normal balance and relationship between the anabolic and catabolic processes, individuals might adversely affect both the rate and amount of acquisition, thus the potential improvement in fitness that would result from the conduct of athletic training.

It is known that the scrotum and testes will sometimes retract when a man is exposed to cold temperatures or engages in demanding physical exercise. The same phenomenon can also be observed when training horses or other mammals. In this regard, nature will normally take care of itself. Accordingly, several problems can be introduced by conventional prior art athletic shorts including an inner liner which elevate and press the male reproductive organs against to the pubic area of the torso. For example, even in warm or hot temperature conditions, the male reproductive organs can be held in a retracted position that is normally associated with the experience of cold temperatures. Further, the subsequent build-up of perspiration induced by such athletic shorts can result in excessive local cooling, and this can possibly affect both thermoregulation and metabolism. Even hours after exercise, when individuals do not remove their perspiration soaked conventional prior art athletic shorts, the male reproductive organs can remain in a relatively cold and retracted state. This condition can be associated with catabolism, thus delayed recovery from exercise and impaired acquisition.

Conventional prior art athletic shorts can also restrict flexion and extension of the legs, and distention of the abdomen during breathing. These factors can influence athletic performance in distance running and other activities. The inventor has two decades of experience as an athlete and coach of distance runners including a member of two U.S. Olympic Teams and a British National Champion upon which to base the practical insights and teachings recited herein.

Accordingly, the co-pending patent application by the present inventor entitled "Novel Athletic Shorts," hereby incorporated by reference herein, teaches improved athletic shorts for use which do not substantially impair flexion or extension of the legs or distention of the abdomen, nor adversely affect heat dissipation, thermoregulation, spermatogenisis, or normal function of the metabolism and endocrine system. Further, the novel athletic shorts are both comfortable and attractive. The anatomical and shock absorbing athletic pants taught in the present invention are configured so as to compliment the functionality of the novel athletic shorts recited in the aforementioned co-pending patent application.

It is known that dancers sometimes tape, or otherwise wrap with stretchlastic bandages their lower legs, and often use numerous stretchlastic leg warmers. In particular, injured athletes will frequently wrap a portion of their lower extremities with stretchlastic material such as "ACE"® bandages in order to protect the affected muscles or tendons and to dampen vibration associated with force applications and impact events. Track and field athletes sometimes use textile covered neoprene rubber wraps for the same purposes and cylindrical stretchlastic tubes into which a portion of their leg can be inserted.

It is also known that the lower legs of horses are often wrapped with a resilient and elastomeric tape for protecting the lower leg and tendons contained therein from injury. Rubber wraps and boots for the lower leg are also used with horses. It is known that some of these articles serve to reduce the shock and vibration imparted to a horse.

A product known by the trademark LASTRAP® made by Cooper, Inc., and now owned by Canstar Sports Group, Inc. is known to dampen shock and vibration. This product contains a flowable viscous material in a bladder which can be affixed in functional relation to an affected body part in order to dampen shock and vibrations. For example, the LASTRAP® article can be applied to the lower leg proximate the tibia for treating shin-splints, or along the forearm proximate the radius or ulna for treating tennis elbow. This product is believed to attenuate the initial shock pulse and can reduce the vibration decay time experienced by the affected part.

Wrist bands are known or believed to attenuate the initial shock pulse and reduce the vibration decay time experienced by the forearm of a wearer. A shoe upper configuration which included a stretchlastic elastomeric material such as textile covered neoprene rubber material that was conceived by the present inventor in early 1989 and is popularly known and commercialized in the footwear industry as the "HUARACHE"® style shoe upper, which is the subject of a non-exclusive license with NIKE, Inc., can encompass at least a portion of a wearer's malleolli and rearfoot. This structure and material is believed to partially attenuate the initial shock pulse and to reduce the vibration decay time experienced by the wearer's lower extremities.

Ski pants having protective pads formed from an elastic material extending from the upper edge of the knee to at least the middle portion of the shin that include features recited as projections are taught in U.S. Pat. No. 4,580,297.

An exercise suit with resilient reinforcing which can be made of a resilient latex rubber and which can traverse the lower leg and overlay a portion of the tibia is taught in U.S. Pat. No. 5,109,546. An undergarment having stretch panels and sock portions is taught in U.S. Pat. No. 5,040,245. A coverall with elastomeric panels is taught in U.S. Pat. No. 4,670,913. An athletic garment with form-fitting panels is taught in U.S. Pat. No. 4,625,336. Trousers for athletic wear having leg sections made of several different materials are taught in U.S. Pat. No. 4,470,156. Pants with an air ventilation panel are taught in U.S. Pat. No. 4,619,004. Hospital trousers having zippers running the full length of the anterior portion of the pant legs are taught in U.S. Pat. No. 5,822,802. Ski pants having zippers running the full length along the sides of the pant legs are known in the prior art. U.S. patents including teachings concerning a seamless crotch construction include U.S. Pat. Nos. 4,261,060, 4,371,989, and 4,488, 317. Ventilated briefs are taught in U.S. Pat. No. 4,009,495. Breathable body wear is taught in U.S. Pat. No. 5,152,014. Pants having a configuration for providing room in the crotch area are taught in U.S. Pat. No. 4,494,250.

The present invention teaches novel athletic pants that compliment the athletic shorts taught in the co-pending patent application by the present inventor entitled Novel Athletic Shorts. Accordingly, the athletic pants permit the male reproductive organs to be substantially suspended naturally. This is believed to lower the temperatures to which the testes are subjected thereby enhancing spermatogenesis, and to facilitate heat dissipation. Further, this characteristic is believed to facilitate optimal thermoregulation within the body. In addition, it is believed to positively influence the operation of sex hormones and anabolic metabolism regarding the process of adaptation and the acquisition of athletic fitness. The preferred athletic shorts and athletic pants also permit relatively unrestricted flexion and extension of the legs, and facilitate distention of the abdomen during breathing. In addition, the athletic pants can include dampening material and means for attenuating shock and vibration. The athletic pants can include textile materials which can provide select heat insulation and resistance to water in select areas. The athletic pants can include vents and closure means for selectively opening and closing the vents and controlling the internal environment of the athletic pants, as desired.

Reference is made to co-pending utility patent application entitled "Novel Athletic Shorts," another co-pending utility patent entitled "Novel Underwear," and three design patent applications entitled, "Article of Apparel Having Non-Stretchlastic Anterior Waist Portion," "Athletic Shorts Inner Liner Having Non-Stretchlastic Anterior Waist Portion," and "Underwear Having Non-Stretchlastic Anterior Waist Portion," filed the same day as the present application, all of these patent application hereby being incorporated by reference herein.

SUMMARY OF THE INVENTION

The present invention teaches athletic pants that permit the male reproductive organs to be substantially suspended naturally, in particular, when used in combination with the novel athletic shorts taught by the present inventor in a co-pending application. The preferred athletic shorts and athletic pants accommodate a wearer's reproductive organs without substantially elevating or pressing the male reproductive organs against the torso in the area of the pubic synthesis. This is believed to lower the temperatures to which the testes are subjected thereby enhancing spermatogenesis, and to facilitate heat dissipation. Further, this characteristic is believed to facilitate thermoregulation within the body. In addition, it is believed to positively influence the operation of sex hormones and anabolic metabolism regarding the process of adaptation and the acquisition of athletic fitness. The athletic pants can facilitate distention of the abdomen and breathing during exercise, and relatively unrestricted flexion and extension of the legs.

The athletic pants include an anterior side, posterior side, superior edge, right side, left side, and upper leg and lower leg portions each having medial and lateral sides. The anterior side of the athletic pants preferably includes inferior retention means, and a superior edge forming a V shape. Alternately, the anterior side includes inferior retention means, and a superior edge forming a U shape. The posterior side of the athletic pants preferably has a horizontal waistline and superior retention means resembling that of conventional prior art athletic pants. A substantially non-stretchlastic material which does not in and of itself place a spring preload upon a wearer's abdomen can be included in the middle portion of the inferior retention means on the anterior side of the athletic pants. The outer layer of the athletic pants can include a hydrophobic material. A preferred pair of athletic pants can include an upper leg having a first textile material having greater heat insulating capability on the anterior side and posterior side, and a second textile material having greater breathability on the lateral side and medial side. The textile material having greater heat insulating capability can be hydrophobic and breathable.

The athletic pants can include vents, and vent closure means for selectively controlling the internal environment of the athletic pants. The athletic pants can include two vents, a first vent positioned on the upper leg on the right side at three o'clock, and a second vent positioned on the upper leg on the left side at nine o'clock, and the superiormost portion of the two vents can be positioned at least six inches below the corresponding superior edge of the athletic pants. Alternately, the athletic pants can include two vents, a first vent positioned on the right side between three and six o'clock, and a second vent positioned on the left side between nine and six o'clock, and the superiormost portion of the two vents can be positioned within eight inches of the corresponding superior edge of the athletic pants. The athletic pants preferably include two vents, a first vent positioned on the right side between four and five o'clock, and a second vent positioned on the left side between seven and eight o'clock, and the superiormost portion of the two vents can be positioned within eight inches of the corresponding superior edge of the athletic pants.

The athletic pants can include means for dampening shock and vibration. Accordingly, the athletic pants can partially attenuate shock and vibration associated with impact events which occur during walking or running, and can reduce the vibration decay time experienced following an impact event. This can possibly serve to enhance comfort, proprioception, reduce local trauma, and solicit greater application of force and improved athletic performance.

Accordingly, a preferred pair of athletic pants can include a longitudinal strip of dampening material positioned on the medial side of a portion of a lower leg of the athletic pants. Alternately, a preferred pair of athletic pants can include a dampening material encompassing the inferior portion of a lower leg. Moreover, a dampening material can extend from an inferior portion of a lower leg for underlying a portion of the plantar aspect of a wearer's foot.

The dampening material can be made of a resilient material comprising a thermoset or a thermoplastic material. The dampening material can be made of natural or synthetic rubber material, including, but not limited to thermoplastic rubber, chloroprene rubber, norborene rubber, butyl rubber, polyurethane, or a combination of butyl and ethylene-propylene rubber. It can be advantageous that the dampening material have a hardness in the range of 10–30 durometer on the Shore A scale.

The dampening material can include a plurality of protrusions. The protrusions can serve as vibration decay time modifiers. The vibration decay time modifiers can have a stem and a head. The head can be dimensioned and configured for vibration substantially free of contact with the base of the dampening material in directions which substantially encompass a 360 degree arc and generally normal to the longitudinal axis of the stem.

DETAILED DESCRIPTION OF THE ILLUSTRATIVE EMBODIMENTS

Figure 1:
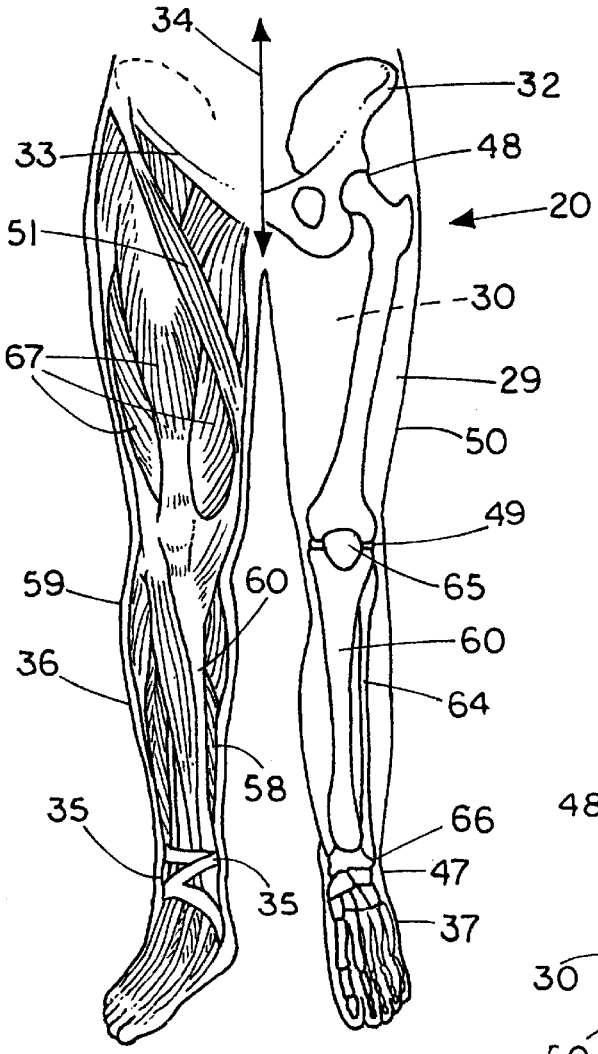
FIG. 1 is an anterior view showing the major bones and muscles of the lower extremities.

The present invention teaches novel athletic pants that permit the male reproductive organs to be substantially suspended naturally, and in particular, when a pair of novel athletic shorts taught in a co-pending patent application by the present inventor are used by a wearer. This is believed to lower the temperatures to which the testes are subjected thereby enhancing spermatogenesis, and to facilitate heat dissipation. Further, this characteristic is believed to enhance thermoregulation within the body. In addition, it is believed to positively influence the operation of sex hormones and anabolic metabolism regarding the process of adaptation and the acquisition of athletic fitness. Accordingly, the athletic pants provide sufficient room so as to not impair the functionality of the novel preferred athletic shorts.

The preferred athletic pants can facilitate distention of the abdomen and breathing during strenuous exercise, and include inferior retention means and a superior edge forming a V shape, or alternately, an arcuate or U shape on the anterior side. The athletic pants can permit relatively unrestricted flexion and extension of the legs.

The athletic pants can include select areas including a textile material which provide enhanced heat insulation and resistance to wind and water.

The athletic pants can include ventilation means such as vents, and closure means for selectively opening or closing the vents and thereby substantially controlling the internal environment of the athletic pants, as desired.

The athletic pants can include a dampening material which can partially attenuate shock and vibration associated with impact events that occur during movements such as walking or running, and can reduce the vibration decay time following an impact event. This can possibly serve to enhance comfort, proprioception, reduce local trauma, and solicit greater application of force and improved athletic performance.

The source of shock and vibration can derive from a relatively controlled and harmonic impact event such as when a wearer of athletic pants repeatedly impacts the pavement while running in athletic shoes. Further, the source of shock and vibration can be random in nature as when a wearer rides a wheeled vehicle such as a bicycle or motorcycle over rough terrain. Alternately, the source of shock and vibration can be constant and driven as when a wearer rides a bicycle, or a motor vehicle such as a motorcycle or snowmobile.

A shock wave, that is, a shock pulse or discontinuity can travel at the speed of sound in a given medium. In the human body, the speed of sound in bone is approximately 3,200 meters/second, and in soft tissue approximately 1,600 meters/second. A shock wave traveling in a relatively dense fluid medium such as water has approximately five times the power that it does in a less dense fluid medium such as air. It is important to recognize that the human body is largely comprised of water or a like fluid medium. It is known that dolphins can hunt using bursts of sound which can disorientate and stun their prey.

When a metal bell is struck, the bell will resonate and continue to ring for an extended time while the vibration energy is gradually dampened out. When a small bell is rung, one can place one's hand upon it and silence it. In that case, the primary dampening means for attenuating the resulting shock and vibration is the anatomy of the human subject. The same thing can happen when an impact event takes place as between an individual's foot and the materials which are used in an athletic shoe, and a running surface. When an individual runs on an asphalt surface in running shoes, the sound of the impact event that one hears is the audible portion of the shock wave that has been generated as result of the impact.

Many individuals know from experience that a vibrating implement or object can numb the hands. This is even more true when the source of the vibration is continuous and driven as when power equipment is being used. Associated with that numbness can be pain, reduced sensation and proprioception, and reduced muscular effort and performance as the body responds to protect itself from a perceived source of trauma and injury. Chronic exposure to high levels of vibration can result in a medical condition known as white finger disease. Generally, the lower extremities of most individuals are not subject to high levels of driven vibration. However, bicycle riders wearing relatively rigid articles of footwear can experience constant driven vibration, thus their feet can become numb or "go to sleep" over time. Motorcycle riders can also experience the same phenomenon.

Athletic pants of the present invention can include spring and dampening means for partially attenuating shock and vibration, that is, the initial shock pulse, pressure wave, discontinuity and associated peak g's that are imparted to a wearer due to an impact event. Further, the preferred athletic pants can serve as a vibration decay time modifier, thus reduce the duration of time that the tibia and lower extremities are excited, and can substantially prevent possible resonance phenomenon during and following a typical impact or other vibration event. In this regard, it can be readily understood that before an object becomes sufficiently excited to actually go into resonance, the exciting energy is often reflected back and forth throughout the medium several times before building in a manner as to cause an observed resonant event. At a cellular or molecular level, such vibration energy is believed to disturb normal functions such as blood flow in tendon tissue.

Given appropriate engineering with respect to the characteristic or desired spring stiffness, mass, deflection, frequency, dampening, and percent transmissibility, athletic pants of the present invention can partially attenuate shock and vibration. Viscous and friction dampening means can be used to attain this end. It is known that the mean power frequency associated with the rearfoot impact event in running generally corresponds to 20 Herz, and that of the forefoot to 5 Herz. The design and configuration, as well as the spring and dampening characteristics of the dampening material can be engineered so as to provide a specific characteristic tuned mechanical response with respect to athletic pants intended for certain end uses such as running.

The preferred athletic pants can include spring and dampening means, hereafter simply referred to as a "dampening material" which is made of a resilient and elastomeric material. Thermoset or thermoplastic materials can be used. However, thermoplastic materials, and the like, can be easier, faster, and less expensive to produce as such can be readily injection molded or injection/compression molded, as opposed to being compression molded using various relatively time and energy consuming vulcanization processes. Dampening materials which can be cured with the use of ultrasonic energy, microwave, visible or ultraviolet light, radio frequency, or other portions of the electromagnetic spectrum can be used. Room temperature cure elastomers, such as moisture or evaporation cure, stochiometric molecular mixture and cure, or catalytic cure resilient materials can also be used.

The preferred dampening material can be made of a natural or synthetic rubber material. A suitable dampening material can be made of a thermoset rubber such as a butyl, chloroprene, polynorborene, neoprene, silicone, and the like, or combinations thereof. Alternately, a dampening material can be made of a thermoplastic material such as polyurethane, or SORBOTHANE®. Suitable hybrid thermoplastic and rubber combinations can be used, including dynamically vulcanized alloys which can be injection molded such as those produced by Advanced Elastomer Systems, 338 Main Street, Akron, Ohio 44311, e.g., SANTOPRENE®, VYRAM®, GEOLAST®, TREFSIN®. SANTOPRENE® is known to consist of a combination of butyl rubber and ethylene-propylene. Generally, other materials developed for use in the audio industry for dampening vibration such as EAR ISODAMP®, SINATRA®, EYDEX®, and the like, or combinations thereof, can be used. Fillers such as organic or inorganic microspheres, carbon black or other conventional fillers can be used. Plasticizing agents, e.g., fluids or oils, can be used to modify the physical and mechanical properties of the dampening material in a desired manner. The preferred dampening material has transition characteristics with respect to operational temperature, and other physical and mechanical properties well suited to dampen and attenuate shock, vibration, and reduce the vibration decay time to which a wearer of athletic pants is subjected.

It can be advantageous that the dampening material have a hardness in the range of 10–30 durometer, and preferably approximately 20 durometer on the Shore A scale. The dampening material is capable a dampening a wide range of exciting vibration frequencies, and also relatively low vibration frequencies. This hardness closely corresponds to that of human skin, and underlying muscle and soft tissue. This is believed to contribute to enhanced proprioception and the positive overall feel provided by the athletic pants. The resulting reduction in neuromuscular inhibition, whether such be derived from the action of neuromuscular feedback loops or cognitive processes, can possibly solicit greater application of force and improved performance.

The dampening material can have a generally planar configuration or can consist of different geometric shapes, such as a plurality of protrusions. Preferably, the plurality of protrusions are configured and engineered to serve as vibration decay time modifiers. The vibration decay time modifiers can include a stem and a head. The head of the vibration decay time modifiers can be dimensioned and configured for vibration substantially free of contact with the base of the dampening material in directions which substantially encompass a 360 degree arc and normal to the longitudinal axis of the stem.

A technology taught by Steven C. Sims in U.S. Pat. No. 5,362,046, granted Nov. 4, 1994, hereby incorporated by reference herein, has been commercialized by Wilson Sporting Goods, Inc. into the SLEDGEHAMMER® INTUNE® tennis rackets, and by Hillerich and Bradsby Company, Inc. in the LOUISVILLE SLUGGER® SIMS STINGSTOP® aluminum baseball and softball bats, as well as the POWERBUILT® SIMS SHOCK RELIEF® golf club line. These products substantially eliminate the vibration and stinging associated with impact events experienced by a wielder's hands. Certain aspects of these teachings, and the like, can also be applied in the present invention in order to accomplish a similar result with respect to athletic pants and the wearer's lower extremities.

Generally, the efficiency of a vibration decay time modifier will be enhanced the closer it is positioned in functional relation to a negative nodal point. When properly configured and placed proximate the negative nodal point of an object or implement, relatively little mass is required in order to substantially prevent, or alternately, to attenuate resonant vibration within fractions of a second. A negative nodal point is a point at which a substantial portion of the vibration energy in an excited object or implement will pass when it is excited by energy associated with an impact or other vibration producing event. Discussion of modes of vibration and negative nodal points can be found in Arthur H. Benade, *Fundamentals of Musical Acoustics,* 2nd edition, New York: Dover Publications, 1990, Harry F. Olson, *Music, Physics and Engineering,* 2nd edition, New York: Dover Publications, 1967, and U.S. Pat. No. 3,941,380 granted to Francois Rene Lacoste on Mar. 2, 1976, this patent hereby being incorporated by reference herein.

The dampening material can be affixed to preferred athletic pants by conventional means such as sewing, adhesive, mechanical bonding, chemical bonding, heat and pressure welding, radio frequency welding, compression molding, injection molding, photocuring and the like. The use of synthetic leather materials derived from thermoplastic materials in the making of athletic pants can facilitate overmolding and bonding of a thermoplastic resilient material thereto.

If desired, the dampening material can be characterized by a relatively high surface energy and high wettability, thus the water contact angle formed on the dampening material can be low. Such a dampening material can then be characterized as being hydrophilic. Conversely, the dampening material can be characterized by a relatively low surface energy and low wettability, thus the water contact angle formed on the dampening material can be high. Such a dampening material can then be characterized as being hydrophobic. A water contact angle measurement of greater than 90 degrees indicates a hydrophobic material, and less than 90 degrees indicates a hydrophilic material. In some cases, a dampening material combining both hydrophilic and hydrophobic materials can be used. As can be readily understood, the choice of hydrophilic and/or hydrophobic material(s) for use on preferred athletic pants will depend upon the particular application and the anticipated environmental conditions associated with the intended end use.

The textiles used to make the preferred athletic pants can be made of natural or synthetic fibers, and blends or combinations thereof. Natural fibers such as cotton, wool, flax, hemp, and the like, can be used. Synthetic fibers such as polyester, polyolefin, polypropylene, nylon, and the like, can be used. LYCRA® brand spandex, or various SUPPLEX® and COOLMAX® textiles made or licensed by E. I. Dupont de Nemours Company can be used. Further, various textiles made by Milliken Research Corporation of Spartanburg, N.C., Burlington Industries, Inc., of Hurt, Va., or Darlington Fabrics Corporation of New York can be used, and the like.

It is known to use substantially waterproof but breathable textiles with respect to gas and water vapor in articles of apparel. These materials are generally grouped into monolithic or non-porometric, and porometric categories. The former generally consist of relatively homogenous materials, whereas the latter commonly utilize laminate treatments which can exhibit millions of tiny holes. Perhaps the best known water vapor breathable treatments are of the porometric variety and commonly include coatings, or membranes which are laminated to a fabric or textile substrate. GORETEX®, manufactured by W. L. Gore and Associates of Newark, Del. is an example of one such selectively permeable material. The principles of operation and composition of GORETEX® is disclosed in detail within U.S. Pat. Nos. 4,344,999, 4,443,511, 4,599,810, 4,809,447, 4,868,928, 4,899,465, 4,961,985, 5,014,363. Detailed technical information concerning ASTM test methods for waterproofness and breatheability are included in the above references. THINTEC®, manufactured by 3M Company, of St. Paul, Minn. constitutes another microporometric material. The composition of THINTEC® laminate consists of 75% polyurethane and 25% polyolefin, and such is then applied to a customer's specified fabric substrate. Other microporous treatments include, but are not limited to BIOCHIN® of Asahi Chemicals, CELTECH® and EXCELTEC® of Unitika, CERAX® of Sominex Prints, DERMOFLEX® of Consoltex Fabrics, EINTECS® of Tomen-Ein, ENTRANT® of Toray Industries, HELLY-TECH® of Helly Hansen, PERMIA® of Somitex Prints of California, UCECOAT 2000® of UCB Chemicals, and ULTREX® of Burlington Industries.

In brief, the pores in water vapor permeable porometric materials are small enough to substantially resist the passage of water molecules in liquid form. This is due in part to surface tension caused by imbalanced molecular forces. Nevertheless, water vapor in a gaseous state can pass by diffusion or convection through what may be millions of tiny pores in the fabric, or textile.

Monolithic, or non-porometric materials form a substantial barrier against the passage of water in liquid form. In brief, when in a liquid state water molecules are strongly attracted to one another and cannot substantially interact with molecules of the monolithic membrane, thus water is repelled. However, water vapor molecules in a gaseous state can readily interact with molecules within the monolithic membrane with which they have an affinity and can use the membrane's molecular chains for transmission through the fabric or textile. Examples of monolithic, or non-porometric materials include, but are not limited to AQUAGUARD/CLIMALINER® of Rotofil, BION II® of Goldschmidt Chemical Co., DARLEXX® of Darlington Fabrics Corp., DRYPEL® of Du Pont, MICROTECH® of Travis Textiles, SYMPATEX® of Akzo, and TRIAD® of Harrison Technologies.

Microfibers merit special attention because they can be readily used for porometric or monolithic applications. The textile industry defines microfiber or microdenier yarns as those which exhibit less than a 1 denier per filament (dpf) count. The denier per filament count of silk is approximately 1 denier, thus even the least fine microfibers are still finer than silk. Microfiber fabric include, but are not limited to CHAMISTE® of Toray, CLIMAGUARD® of Schoeller/Rotofil, C.D.Y. "MICRO"® and GYMSTAR PLUS® of Unitika America, FORTREL MICROSPUN® of Fiber Industries, LEOFINO® of Asashi, MICROSOFT® of Tejin, MICROSUPPLEX® of Du Pont, TACTEL MICRO® of ICI Fibers, TREVIRA FINESSE® of Hoechst A. G., ULTREX® and VERSATECH® of Burlington Industries, and ZEPHYR 200® of Kanebo Ltd.

FIG. 1 is an anterior view of a wearer 20 showing the major bones and muscles of the lower extremities. Shown is the tibia 60, fibula 64, foot 37, lower leg 36, upper leg 50, patella 65, knee joint 49, malleolli 35, ankle joint 66, femur 68, hip joint 48, iliac crest 32, inguinal ligament 33, abdomen 28, waist 24, rectus abdominis muscle 38, torso 31, middle of torso 34, quadricep muscles 67, sartorius muscle 51, anterior side 29, and posterior side 30.

Figure 2:
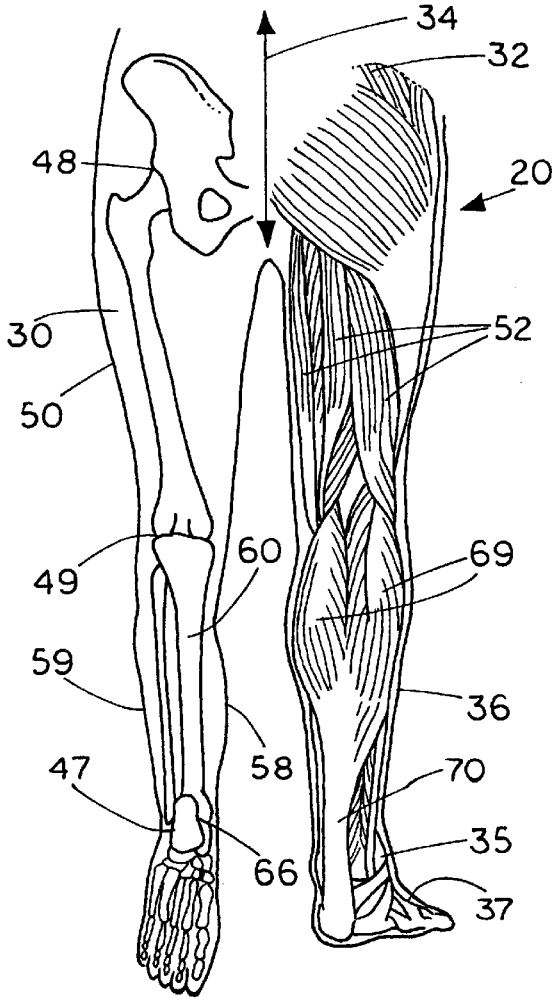
FIG. 2 is a posterior view showing the major bones and muscles of the lower extremities.

FIG. 2 is a posterior view of a wearer 20 showing the major bones and muscles of the lower extremities. Shown is the tibia 60, fibula 64, foot 37, lower leg 36, upper leg 50, knee joint 49, malleolli 35, ankle joint 66, femur 68, hip joint 48, iliac crest 32, waist 24, torso 31, middle of torso 34, hamstring muscles 52, calf muscles 69, achilles tendon 70, and posterior side 30.

Figure 3:
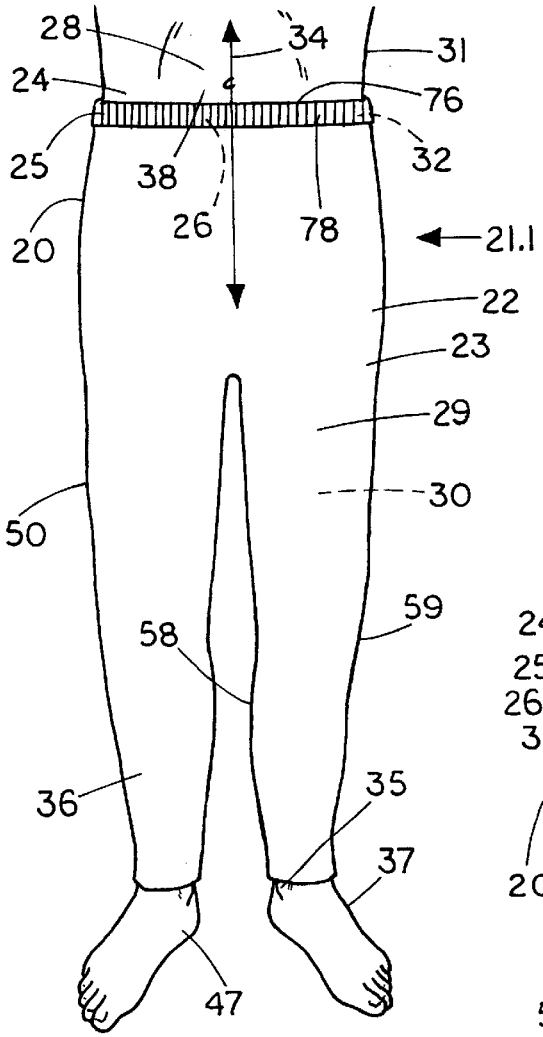
FIG. 3 is an anterior view of prior art athletic pants on a wearer.

As shown in FIG. 3, a wearer 20 has donned a pair of prior art athletic pants 21.1 having an outer layer 22 for covering a substantial portion of the lower extremities. The athletic pants 21 can be retained about the individual's waist 24 by retention means 25, such as a by string draw, elastic, button and hole, or other mechanical means known in the art. Shown are superior retention means 78 which pass directly across the abdomen 38 of the wearer, that is, the superior edge 76 of the athletic pants 21.1 on the anterior side 29 extends substantially horizontally and generally consistent with a line which is perpendicular to the middle 34 of the torso 31. This configuration commonly requires a wearer 20 to overcome the preload spring resistance associated with the retention means 25 while distending the abdomen and can thereby inhibit or restrict breathing during strenuous exercise.

Figure 4:
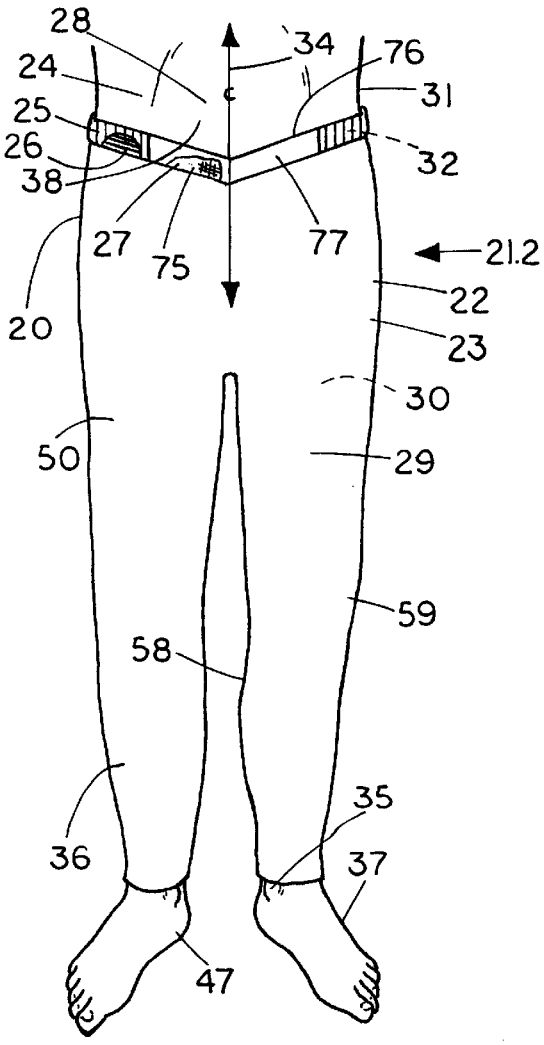
FIG. 4 is an anterior view of athletic pants having a V shape on a wearer.

Shown in FIG. 4 is the anterior side 29 of a preferred pair of athletic pants 21.2 which include retention means 25 that consist of preferred inferior retention means 77 for extending across the lower abdomen 28 of a wearer 20. The inferior retention means 77 used on the anterior side 29 of the athletic pants 21 is configured to accommodate distention of the abdomen 28 during breathing. When the preferred athletic pants 21 are viewed from the anterior side 29 on a wearer 20, the left and right portions of the superior edge 76 of the athletic pants 21 and the inferior retention means 77 descend from areas proximate the opposing iliac crests 32 of the hips at a downward angle towards the middle 34 of the torso 31 and the athletic pants 21.2 so as to form a V shaped configuration. Inferior retention means 77 can better accommodate for the anatomical structure of the lower portion of the rectus abdominis muscle 38, and the distention of the abdomen 28 which takes place during full respiration and strenuous exercise. As shown in FIG. 4, it can be advantageous to use a substantially non-stretchlastic material 27 such as belting 75, that is, a material which does not in and of itself place a spring preload upon a wearer's abdomen 28, in the middle 34 portion of the inferior retention means 77 on the anterior side 29 of the athletic pants 21.2. Athletic pants 21.2 including this type of configuration can be advantageous for use by female as well as male users. Further, athletic pants 21 made for male users can be configured as to provide ample space to accommodate the male reproductive organs. It can be advantageous that the male reproductive organs be substantially suspended naturally, that is, not be substantially elevated and pressed against the torso in the area of the pubic synthesis. Accordingly, in order to create an appropriate configuration and pattern for the preferred athletic pants, it can be advantageous for a wearer to don an appropriate size of the preferred athletic shorts taught in the co-pending patent application entitled Novel Athletic Shorts during pattern making, and for graded sizes to be made from the confirmed configuration and pattern of the novel athletic pants 21.2 derived therefrom.

The outer layer 22 can substantially consist of a natural or synthetic textile material 23, or a blend and hybrid combination thereof including but not limited to cotton, wool, flax, hemp, polyester, polyolefin, polypropylene, nylon, and various textiles made by Milliken Research Corporation, Burlington Industries, Inc., or Darlington Fabrics Corporation, and the like. Prior art athletic pants 21 have included various hydrophilic and hydrophobic materials, and sometimes in combination. Non-stretchlastic material 27 or a stretchlastic material 26, such as LYCRA® brand spandex, or various SUPPLEX® and COOLMAX® textiles made or licensed by E. I. Dupont de Nemours Company can be used. A stretchlastic material 26 can consist of two-way, three-way or any other type of stretchlastic material. The athletic pants 21 can be formed of a material which is relatively porous, non-heat retaining, and breathable, or alternately, a material which is relatively non-porous and heat retaining depending upon the anticipated environmental conditions for which the athletic pants 21 are being made. The former construction would be suitable for use in the summer months and hotter weather, and the latter would be suitable for use in winter months and cold weather in which a penetrating wind chill could be encountered. Select hydrophilic and/or hydrophobic materials, as well as materials having select thermal insulation properties can be used in various locations to make athletic pants 21.

Figure 5:
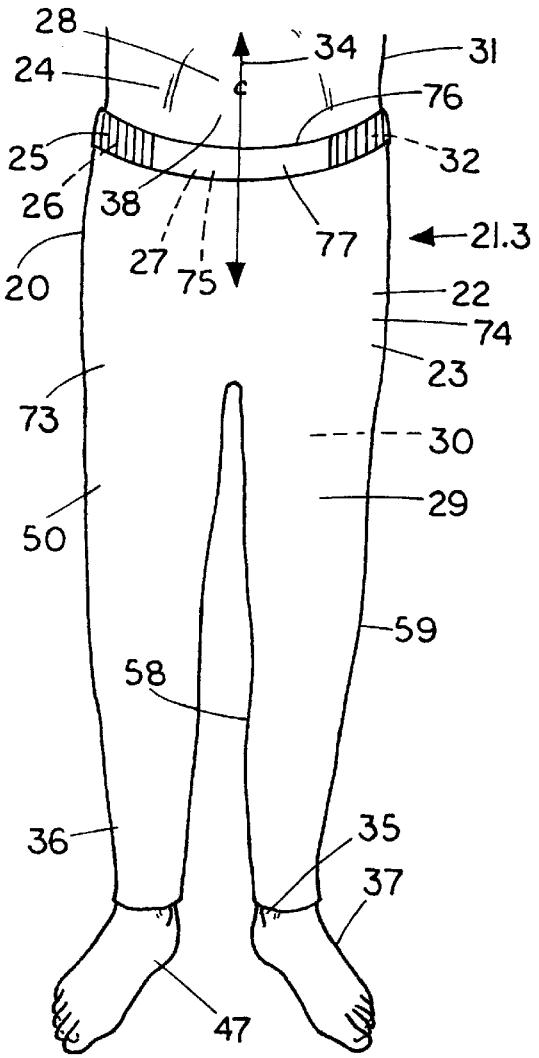
FIG. 5 is an anterior view of athletic pants having an arcuate or U shape on a wearer.

Shown in FIG. 5 is the anterior side 29 of preferred athletic pants 21.3 including inferior retention means 77 and having a superior edge 76 forming a U shaped configuration on a wearer 20. Again, athletic pants 21.3 including inferior retention means 77 can be advantageous for use by female as well as male users.

Figure 6:
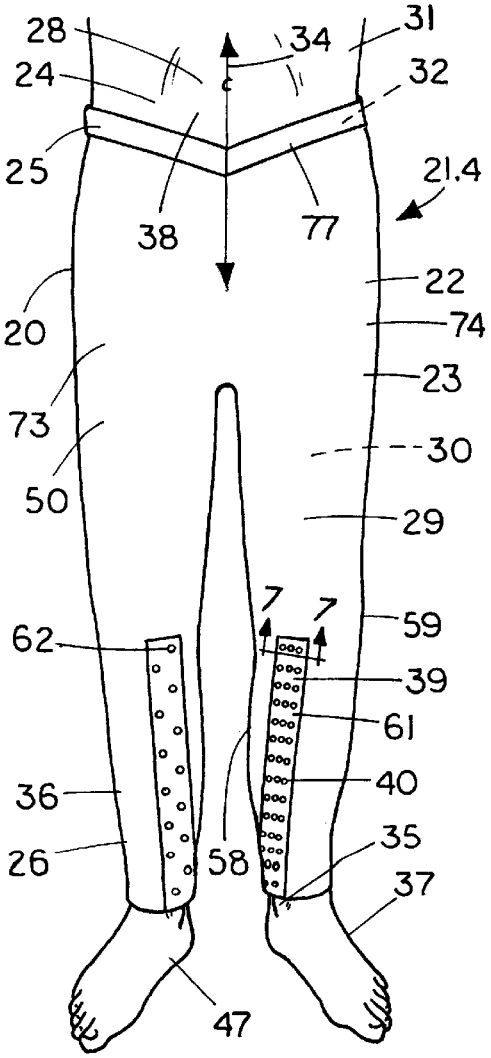
FIG. 6 is an anterior view of athletic pants on a wearer including a longitudinal strip of dampening material positioned on the medial side of the lower leg showing a generally planar dampening material on the wearer's right side, and a dampening material having protrusions on the wearer's left side.

Shown in FIG. 6 is the anterior side 29 of preferred athletic pants 21.4 including inferior retention means 77 and having a superior edge 76 forming a V shaped configuration on a wearer 20. The athletic pants 21.4 can further include a longitudinal strip 61 of dampening material 39 positioned so as to overlay a substantial portion of the tibia 60 of a wearer. Accordingly, the longitudinal strip 61 of dampening material 39 can be positioned on the anterior side 29 of the athletic pants 21.4 and located on the medial side 58 of each respective lower leg 36. The dampening material 39 can attenuate a portion of the shock pulse or discontinuity generated by impact with a support surface, and decrease the vibration decay time of the tibia 60. As shown on the right side 73 of the wearer 20 in FIG. 6, the dampening material 39 can be at least partially perforated and include openings 62 for enhancing ventilation. The dampening material 39 can be generally planar or laminar in configuration. Alternately, as shown on the left side 73 of the wearer 20 in FIG. 6, the dampening material 39 can have peaks and valleys, or protrusions 40 extending therefrom.

It can be advantageous that the dampening material 39 be secured in direct contact with the wearer's skin and proximate to the underlying tibia 60. The presence and use of an elastic or stretchlastic material 26 or like textile material 23 in the construction of at least the lower leg 36 portion of the athletic pants 21 can cause the dampening material 39 to be held in contact, or caused to be placed in a prestressed state in which the dampening material 39 has been caused to elongate, when the athletic pants 21.4 are donned by a wearer. A stretchlastic textile material 23 such as LYCRA® brand spandex made by E. I. Dupont de Nemours Company, can be used, as can various textiles made by Milliken Research Corporation, Burlington Industries Inc., or Darlington Fabrics Corporation, and the like. The stretchlastic material 26 can consist of two-way, three-way or any other type of stretchlastic material.

Figure 7:
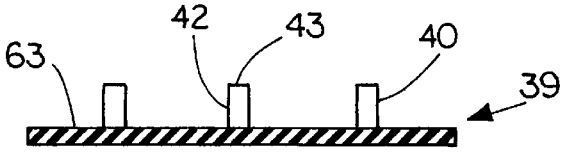
FIG. 7 is a cross-sectional view taken along line 7—7, of the dampening material having protrusions shown on the wearer's left side in FIG. 6.

FIG. 7 is a cross-sectional view taken along line 7—7, of the dampening material 39 shown on the left side 74 of the wearer 20 shown in FIG. 6, showing protrusions 40 which are configured and engineered so as to constitute vibration decay time modifiers 41. Each vibration decay time modifier 41 has a stem 42 and a head 43. The head 43 of the vibration decay time modifier 41 can be dimensioned and configured for vibration substantially free of contact with the base 63 of the dampening material 39 in directions which substantially encompass a 360 degree arc and generally normal to the longitudinal axis of the stem 42 of the vibration decay time modifier 41. As shown, the diameter of the head 43 is equal to or less than that of the stem 42. The excitation of vibration decay time modifiers 41 results in rapid dispersion and conversion of the mechanical energy associated with shock and vibration by dampening into heat. Combinations of protrusions 40 having different sizes and shapes are possible.

Figure 8:
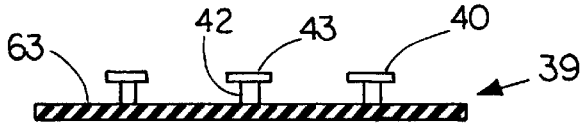
FIG. 8 is a cross-sectional view similar to that shown in FIG. 7 of an alternate dampening material having protrusions.

FIG. 8 is a cross-sectional view similar to that shown in FIG. 7, showing a dampening material 39 having alternate protrusions 40 which are configured and engineered so as to constitute preferred vibration decay time modifiers 41. Each vibration decay time modifier 41 has a stem 42 and a head 43. The head 43 of the vibration decay time modifier 41 can be dimensioned and configured for vibration substantially free of contact with the base 63 of the dampening material 39 in directions which substantially encompass a 360 degree arc and generally normal to the longitudinal axis of the stem 42 of the vibration decay time modifier 41. It can be advantageous for the ratio of the diameter of the head 43 to the diameter of the stem 42 to be at least 2/1. The excitation of vibration decay time modifiers 41 results in rapid dispersion and conversion of the mechanical energy associated with shock and vibration by dampening into heat. Combinations of protrusions 40 having different sizes and shapes are possible.

Figure 9:
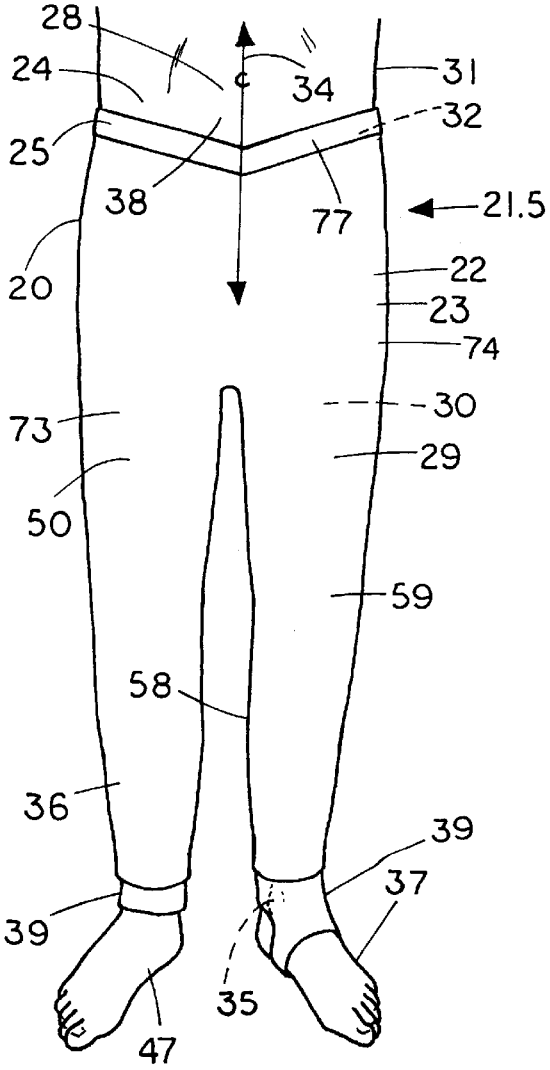
FIG. 9 is an anterior view showing dampening material encompassing an inferior portion of the lower leg of athletic pants.

As shown in FIG. 9, alternate preferred athletic pants 21.5 can include dampening material 39 at an inferior position proximate the malleolli 35 or ankle joints 66 of a wearer 20. The dampening material 39 can substantially or completely encompass the lower leg 36 and/or malleolli 35. The dampening material can be resilient and elastomeric and thereby permit the foot 37 to pass therethrough, and/or conventional closure means 44 can be used, such as VELCRO® hook and pile, zipper, button or snap means. The configuration shown on the right side 73 of the wearer 20 shown in FIG. 9 is generally annular 45 and substantially encompasses the inferior portion of the lower leg 36 of the athletic pants 21.5. The configuration shown on the left side 74 of the wearer 20 shown in FIG. 9 is generally annular 45, but also includes a plantar strap 46 for retaining the inferior portion of the athletic pants 21.5 in position.

Figure 10:
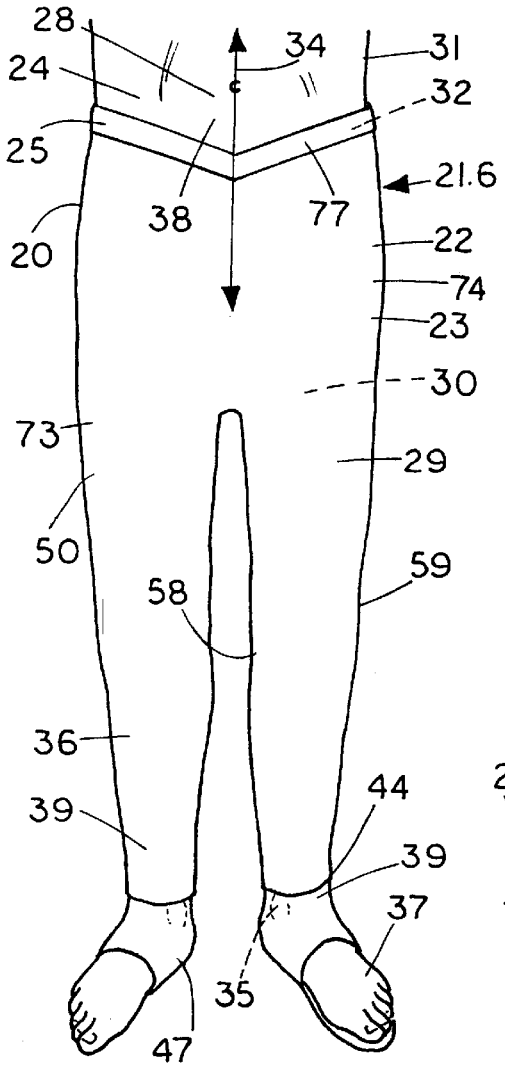
FIG. 10 is an anterior view showing dampening material encompassing an inferior portion of the lower leg of athletic pants and extending therefrom for underlying a portion of the plantar aspect of a wearer's foot.

As shown in FIG. 10, alternate preferred athletic pants 21.6 can include dampening material 39 at an inferior position on the lower leg 36 proximate the malleolli 35 or ankle joints 66 of a wearer 20. The dampening material 39 can substantially or completely encompass an inferior portion of the lower leg 36 of the athletic pants 21.6. The dampening material can be resilient and elastomeric and thereby permit the foot 37 to pass therethrough, and/or conventional closure means 44 can be used, such as VELCRO® hook and pile, zipper, button or snap means. The configuration shown on the right side 73 of the wearer 20 shown in FIG. 10 is generally annular 45 and substantially encompasses the inferior portion of the lower leg 36 and extends for underlying a plantar portion of the wearer's 20 rearfoot 47. The configuration shown on the left side 74 of the wearer 20 shown in FIG. 10 is generally annular 45, and extends such as to underlie substantially the entire plantar portion of the wearer's 20 foot 27.

Figure 11:
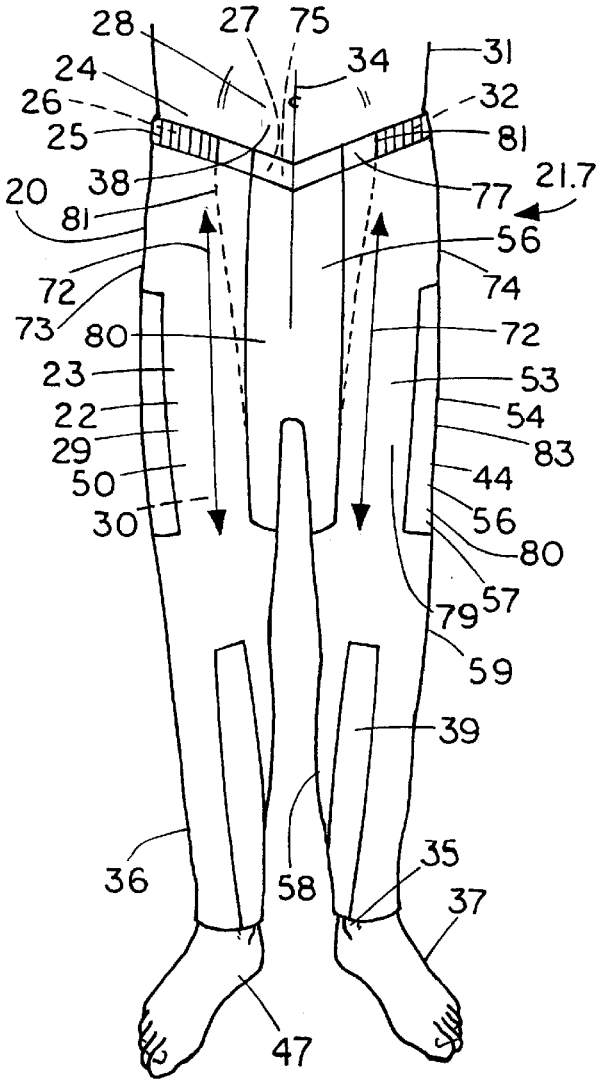
FIG. 11 is an anterior view of athletic pants including two different textile materials.
Figure 12:
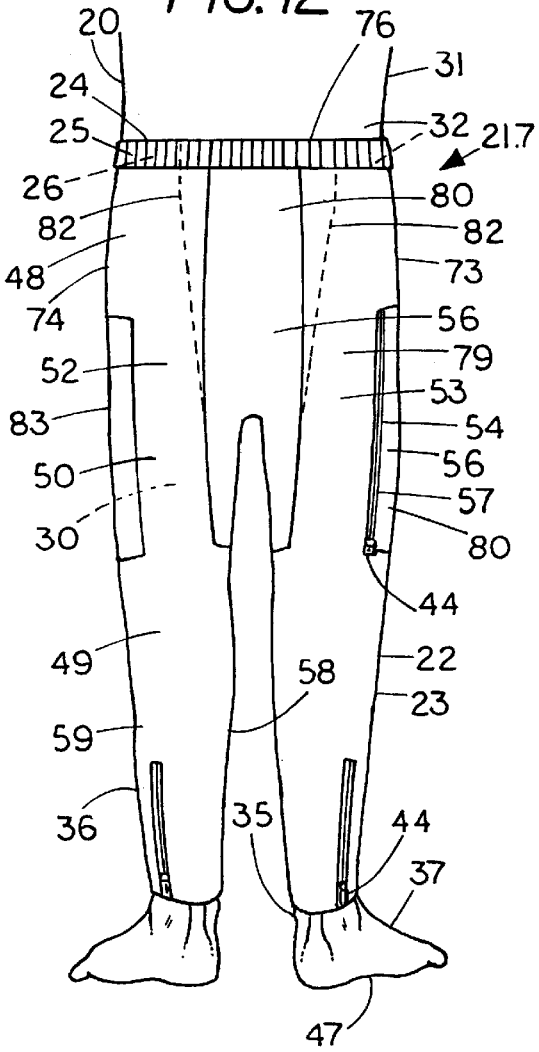
FIG. 12 is a posterior view of the athletic pants shown in FIG. 11.

Shown in FIG. 11 is the anterior side 29 of alternate preferred athletic pants 21.7 including a first textile material 79 having relatively greater heat insulation capability, and/or wind and water resistance, herein simply referred to as heat insulating material 53, which can be used about the area of the hip joints 48, knee joints 49, and generally longitudinally about vertical line(s) 72 which indicate the anteriormost portion of the upper leg 50. The athletic pants 21.7 can thereby protect portions of the lower extremities which have greatest exposure or risk of injury given the possible chilling effects of rain, wind, snow, and other cold weather conditions. The relatively superficial sartorius muscle 51 of the upper leg 50 is especially vulnerable to the effect of chilling or wet conditions, and in particular, when an athlete is fatigued. The first textile material 79 consisting of heat insulating material 53 can also be used on the an anterior side 29 of the lower leg 36 portion of the athletic pants 21.7. It can be readily understood that each upper leg 50 and lower leg 36 portion of an athletic pants 21 has a medial side 58 and a lateral side 59. A second textile material 80 which is a relatively breathable material 56 can be used on the lateral sides 59 of at least a portion of the upper leg 50 of the athletic pants 21.7. As shown in FIGS. 11 and 12, second textile material 80 can be used on the medial sides 58 of at least a portion of the upper leg 50 and can extend superiorly along the middle 34 of the garment to the position of inferior retention means 77 on the anterior side 29, and to the position of superior retention means 78 on the posterior side 30. Alternately, second textile material 80 can extend superiorly on the anterior side 29 as shown in FIG. 11 by phantom dashed line 81, and on the posterior side 30 as shown in FIG. 12 by phantom dashed line 82. The athletic pants 21 can include ventilation means 57 such as vents 54 and mesh 55. The ventilation means 57 can simultaneously include pockets 83, and vice versa, pockets 83 can simultaneously include ventilation means 57. Vents 54 can be selectively opened and closed by conventional closure means 44 including but not limited to zipper, VELCRO® hook and pile, and the like, which permit the wearer 20 to regulate the internal environment of the athletic pants 21. The athletic pants 21 can thereby provide protection from the elements, and at the same time avoid causing an excessive build-up of heat and perspiration.

Shown in FIG. 12 is a posterior view of the alternate preferred athletic pants 21.7 shown in FIG. 11. The athletic pants 21.7 can include a conventional and substantially horizontal waistline and superior retention means 78 at the superior edge 76 on the posterior side 30. The athletic pants 21 can include a first textile material 79 having greater heat insulation value 53, and/or wind and water resistance, herein simply referred to as heat insulating material 53, which can be used about the area of the hip joints 48, knee joints 49, and generally longitudinally along the posteriormost portion of the upper leg 50. The athletic pants 21.7 can thereby protect those portions of the lower extremities which have greatest exposure or risk of injury given the possibly chilling effects of rain, wind, snow, and other cold weather conditions. The hamstring muscles 52 of the upper leg 50 are especially vulnerable to the effect of chilling or wet conditions, and in particular, when an athlete is fatigued. The first textile material 79 consisting of heat insulating material 53 can also be used on the posterior side 30 of the lower leg 36 of the athletic pants 21.7. It can be readily understood that each upper leg 50 and lower leg 36 portion of an athletic pants 21 has a medial side 58 and a lateral side 59. A second textile material 80 which is a relatively breathable material 56 can be used on the lateral sides 59 of at least a portion of the upper leg 50 of the athletic pants 21.7. Further, second textile material 80 can be used on the medial sides 58 of at least a portion of the upper leg 50 and can extend superiorly along the middle 34 of the athletic pants 21.7 to the position of inferior retention means 77 on the anterior side 29, and to the position of superior retention means 78 on the posterior side 30. Alternately, second textile material 80 can extend superiorly on the anterior side 29 as shown in FIG. 11 by phantom dashed line 81, and on the posterior side 30 as shown in FIG. 12 by phantom dashed line 82. Ventilation means 57 such as vents 54 and mesh 55 can be included on the athletic pants 21 taught herein. The ventilation means 57 can simultaneously include pockets 83, and vice versa, pockets 83 can simultaneously include ventilation means 57. Vents 54 can be selectively opened and closed by conventional closure means 44 including but not limited to zipper, VELCRO® hook and pile, and the like, which permit the wearer 20 to substantially regulate the internal environment of the athletic pants 21. The athletic pants 21 can thereby provide protection from the elements, and at the same time avoid causing excessive build-up of heat and perspiration.

Figure 13:
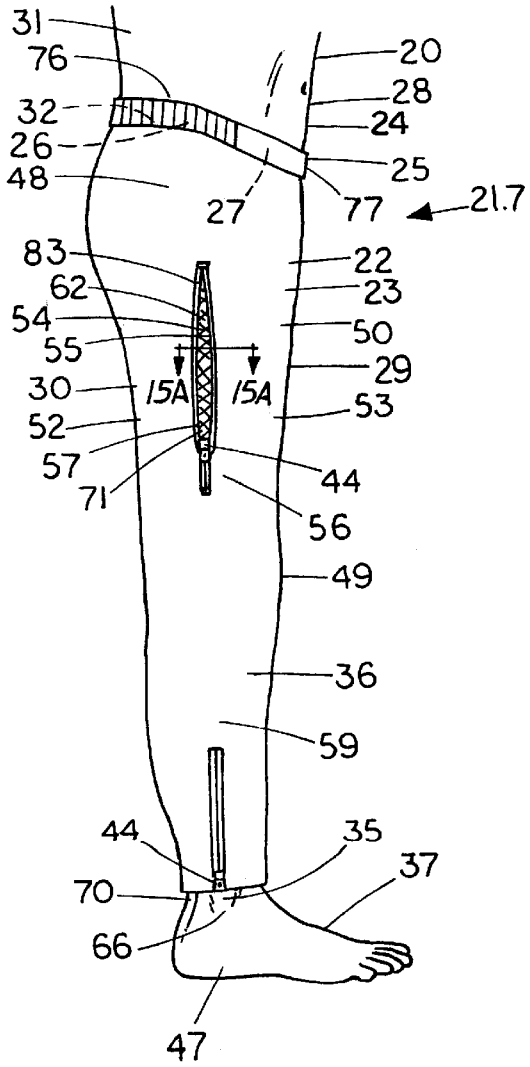
FIG. 13 is a side view of a vent for use on the athletic pants.

FIG. 13 is a side view of an alternate preferred athletic pants 21.7 having vents 54 including mesh 55 which can be used on the right side 73 and left side 74 of athletic pants 21. The outer layer 22 can overlap an inner layer 71 which can consist of a highly breathable material 56, such as a mesh material 55 in the area of the vents 54. The ventilation means 57, such as vents 54, can simultaneously include pockets 83, and vice versa, pockets 83 can simultaneously include ventilation means 57. Alternately, the vents 54 can simply consist of an opening 62. The outer layer 22 can be affixed by intermittent stitching, buttons, snaps, so as to at least partially close vents 54. When the vents 54 are maintained in a relatively closed position by intermittent stitching or other conventional means, it can be readily understood that the vents 54 will remain so when the athletic pants 21 are not being flexed or distended through the movements of the wearer. Thus, when standing, sitting, or stretching the vents 54 will remain relatively closed. However, it can be readily understood that the vents 54 can be caused to open as the athletic pants 21 undergo flexion, shear, or other stress and deformation during movement, thus having a greater heat and perspiration dissipating effect when an individual is exercising as opposed to when the individual is relatively inactive.

Figure 14:
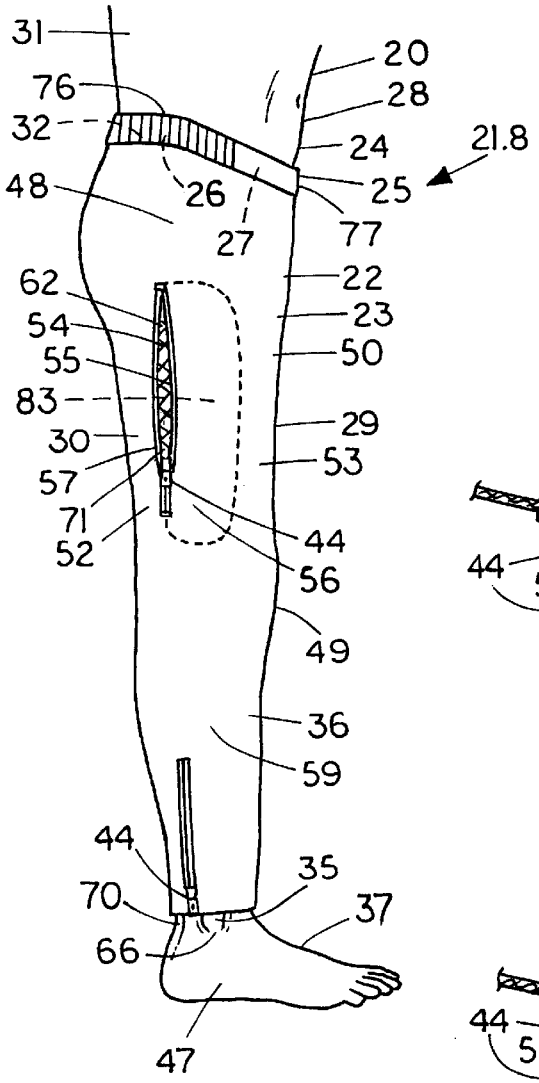
FIG. 14 is a side view of an alternate vent for use on the athletic pants.

Preferably, the vents 24 include zipper, VELCRO® hook and pile, or other conventional closure means 44 which permit the vents 54 to be selectively opened and closed as desired by a wearer 20, as shown in FIGS. 13–14. In this way, a wearer 20 can substantially control the environmental conditions within athletic pants 21. Often, a wearer 20 will desire the vents 54 to be substantially or completely closed when beginning to warm up, while stretching, or waiting for the start of an outdoor athletic event, and likewise after an athletic event or when traveling, in particular, given cool or cold external environmental conditions. However, once fully warmed up, a wearer 20 will often desire to maintain or reduce the temperature and humidity generated within the athletic pants 21. Accordingly, the vents 54 can be selectively opened or closed to the degree that is desired. In the anterior view shown in FIG. 11, the vertical line 72 bisecting the upper leg 50 of the athletic pants 21 establishes the twelve o'clock position for reference purposes. As shown in FIG. 13, when the vents 54 are positioned at the three o'clock position on the upper leg 50 on the right side 73 and the corresponding nine o'clock position on the upper leg 50 on the left side 74, it can be advantageous for the superior-most portion of the vents 54 to be positioned at least six inches below the superior edge 76 of the athletic pants 21.7 on each respective side in order to lessen the possibility of the wearer's 20 hands snagging and possibly tearing the garment as the hands pass near the hips while running. Again, the ventilation means 57, such as vents 54, can simultaneously include pockets 83, and vice versa, pockets 83 can simultaneously include ventilation means 57.

FIG. 14 is a side view of preferred athletic pants 21.8 having a vent 54 including mesh 55 located on the upper leg 50 on the right side 73 of the athletic pants 21.8. Again, in the anterior view shown in FIG. 11, the vertical line 72 bisecting the upper leg 50 of the athletic pants 21 establishes the twelve o'clock position for reference purposes. The vent 54 on the wearer's 20 and thus the athletic pant's 21.8 right side 73 is preferably located between the three and six o'clock position, and in particular, between the four and five o'clock position. It can be readily understood that use of the word "between" herein is intended to be inclusive of the delimiting values of a given indicated range. The vent 54 on the wearer's 20 and thus the athletic pant's 21.8 left side 74 is preferably located between the nine and six o'clock position, and in particular, between the seven and eight o'clock position. It can be advantageous that the superior-most portion of the vents 54 be located within eight inches of the superior edge 76 of the athletic pants 21.8 on each respective side, as heated air naturally rises and can then better escape. In addition, this position facilitates use by a wearer 20 of selective closure means 44 and vents 54, and can lessen the possibility of the wearer's 20 hands snagging and possibly tearing the garment as the hands pass near the hips while running. As shown in FIG. 14, the orientation of the vents 54 can also fall along the same general vertical line or curve established by the closure means 44 associated with the lower leg 36 portions of the athletic pants 21.8, and vice-versa, thus fulfilling both functional and aesthetic design purposes. Alternately, a vent 54 can be located and orientated horizontally on the posterior side 30 of the athletic pants 21.8 near the inferior edge of retention means 25.

The outer layer 22 can overlap an inner layer 71 which includes a highly breathable material 56, such as a mesh material 55 in the area of the vents 54. Alternately, the vents 54 can simply consist of an opening 62. The outer layer 22 can be tacked by intermittent stitching, buttons, snaps, so as to at least partially close vents 54, or preferably selectively affixed in functional relation by zipper, VELCRO® hook and pile, or other conventional closure means 44 to permit the vents 54 to be selectively opened and closed as desired by a wearer 20. Again, the ventilation means 57, such as vents 54, can simultaneously include pockets 83, and vice versa, pockets 83 can simultaneously include ventilation means 57.

Figure 15A:
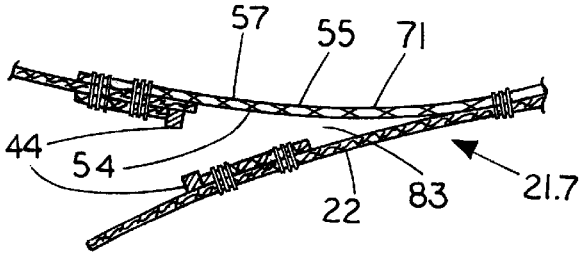
FIG. 15*a* is a transverse cross-sectional view of the vent shown in FIG. 13, taken along line 15*a*—15*a*.

FIG. 15*a* is a transverse cross-sectional view taken along line 15*a*—15*a* in FIG. 13, showing a vent 54 including mesh 55 which can be used along the lateral sides 59 of athletic pants 21. The outer layer 22 overlaps an inner layer 71 which can include a highly breathable material 56 such as a mesh material 55. Alternately, the vents 54 can simply consist of an opening 62. The vents 54 can include a zipper as shown, or other conventional closure means, thus permitting the vents 54 to be selectively opened and closed, as desired. In this way, a wearer 20 can substantially control the environmental conditions within athletic pants 21. Again, the ventilation means 57, such as vents 54, can simultaneously include pockets 83, and vice versa, pockets 83 can simultaneously include ventilation means 57.

Figure 15B:
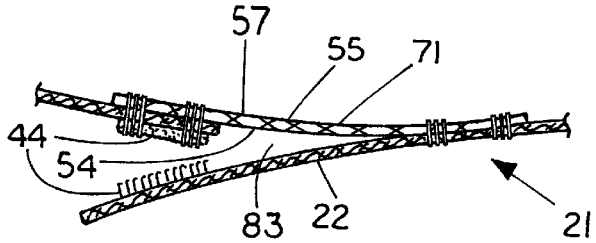
FIG. 15*b* is a transverse cross-sectional view similar to that shown in FIG. 15*a* of an alternate vent including hook and pile closure means for use in athletic pants.

FIG. 15*b* is a transverse cross-sectional view similar to that shown in FIG. 15*a,* showing a vent 54 including mesh 55 which can be used along the lateral sides 59 of athletic pants 21. The outer layer 22 overlaps an inner layer 71 which can include a highly breathable material 56 such as a mesh material 55. Alternately, the vents 54 can simply consist of an opening 62. The vents 54 can include VELCRO® hook and pile as shown, or other conventional closure means, thus permitting the vents 54 to be selectively opened and closed, as desired. Again, the ventilation means 57, such as vents 54, can simultaneously include pockets 83, and vice versa, pockets 83 can simultaneously include ventilation means 57.

Figure 15C:
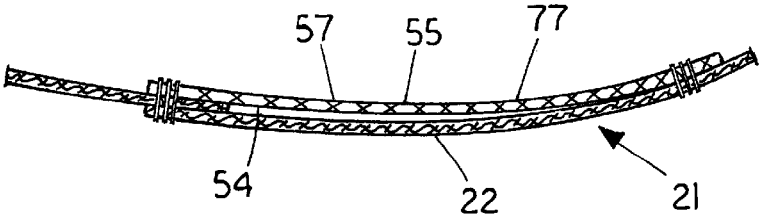
FIG. 15*c* is a transverse cross-sectional view similar to that shown in FIG. 15*a* of an alternate vent including intermittent stitch closure means for use in athletic pants.

FIG. 15*c* is a transverse cross-sectional view similar to that shown in FIG. 15*a,* showing a vent 54 including mesh 55 which can be used along the lateral sides 59 of athletic pants 21. The outer layer 22 overlaps an inner layer 71 which can include a highly breathable material 56 such as a mesh material 55. Alternately, the vents 54 can simply consist of an opening 62. The outer layer 22 can be affixed by intermittent stitching, or other conventional means. Again, when the vents 54 are maintained in a relatively closed position by intermittent stitching or other conventional means, the vents 54 will remain so when the athletic pants 21 are not being flexed or distended through the movements of the wearer. Thus, when standing, sitting, or stretching the vents 54 will remain relatively closed. However, it can be readily understood that the vents 54 can be caused to open as the athletic pants 21 undergo flexion, shear, or other stress and deformation during movement, thus having a greater heat and perspiration dissipating effect when an individual is running as opposed to when the individual is relatively inactive.

It can be readily understood that the teachings shown in the drawing figures and disclosed herein can possibly be combined in various partial or complete combinations. For example, the preferred vents 54 can be used with the various embodiments of athletic pants 21 recited herein and illustrated in the drawing figures. While the above detailed description of the invention contains many specificities, these should not be construed as limitations on the scope of the invention, but rather as exemplifications of several preferred embodiments thereof. Many other variations are possible. Accordingly, the scope of the invention should be determined not by the embodiments discussed or illustrated, but by the appended claims and their legal equivalents.

Although the present invention has been described with reference to preferred embodiments, workers skilled in the art will recognize that changes may be made in form and detail without departing from the spirit and scope of the invention.

What is claimed is:

1. Athletic pants for use by a wearer having an outer layer, anterior side, posterior side, superior edge, right side, left side, and upper leg and lower leg each having medial and lateral sides, comprising a substantially horizontal waistline and superior retention means on said posterior side, and inferior retention means and a superior edge forming a V shape on said anterior side, said inferior retention means substantially comprising a non-stretchlastic material.

2. The athletic pants according to claim 1, further comprising a configuration for permitting the male reproductive organs to be substantially suspended naturally.

3. The athletic pants according to claim 1, further comprising a first textile material having greater heat insulating capability relative to a second textile material which is more breathable, said first textile material positioned on said anterior side and said posterior side of said upper leg, said second textile material positioned on said lateral side of said upper leg and on said medial side of said upper leg and extending superiorly along the middle of said athletic pants to said inferior retention means on said anterior side.

4. The athletic pants according to claim 3, wherein said first textile material having greater heat insulating capability is hydrophobic and breathable.

5. The athletic pants according to claim 1, further comprising a pocket.

6. The athletic pants according to claim 5, wherein said pocket further comprises closure means and can be selectively opened and closed.

7. The athletic pants according to claim 6, wherein said pocket further comprises a vent.

8. The athletic pants according to claim 1, further comprising two vents, a first vent positioned on said upper leg on said right side between three and six o'clock, the superiormost portion of said first vent positioned within eight inches of said superior edge of said athletic pants on said right side, and a second vent positioned on said upper leg on said left side between nine and six o'clock, the superiormost portion of said second vent positioned within eight inches of said superior edge of said athletic pants on said left side, the positions being oriented to a clock face wherein the six o'clock positions are on vertical lines bisecting posterior sides of the upper legs.

9. The athletic pants according to claim 8, wherein said first vent is positioned on said right side between four and five o'clock, and said second vent is positioned on said left side between seven and eight o'clock.

10. The athletic pants according to claim 1, comprising a longitudinal strip of dampening material on said medial side of said lower leg.

11. The athletic pants according to claim 10, wherein said dampening material comprises a plurality of protrusions comprising vibration decay time modifiers.

12. The athletic pants according to claim 11, wherein said vibration decay time modifiers each comprise a stem and a head, said head dimensioned and configured for vibration substantially free of contact with the base of said dampening material in directions which substantially encompass a 360 degree arc and generally normal to the longitudinal axis of said stem.

13. The athletic pants according to claim 1, comprising a dampening material encompassing an inferior portion of said lower leg.

14. The athletic pants according to claim 13, wherein said dampening material has a hardness in the range between 10–30 durometer on the Shore A scale.

15. Athletic pants for use by a wearer having an outer layer, anterior side, posterior side, superior edge, right side, left side, and upper leg and lower leg each having medial and lateral sides, comprising a substantially horizontal waistline and superior retention means on said posterior side, and inferior retention means and a superior edge forming a U shape on said anterior side, said inferior retention means substantially comprising a non-stretchlastic material.

16. The athletic pants according to claim 15, further comprising a configuration for permitting the male reproductive organs to be substantially suspended naturally.

17. Athletic pants for use by a wearer having an outer layer, anterior side, posterior side, superior edge, right side, left side, and upper leg and lower leg each having medial and lateral sides, and comprising two pockets, a first pocket positioned on said upper leg on said right side between three and six o'clock, the superiormost portion of said first pocket positioned within eight inches of said superior edge of said athletic pants on said right side, and a second pocket positioned on said upper leg on said left side between six and nine o'clock, the superiormost portion of said second pocket positioned within eight inches of said superior edge of said athletic pants on said left side, the vent positions being oriented to a clock face with the six o'clock positions on posterior bisecting lines of the upper legs.

18. The athletic pants according to claim 17, wherein said first pocket is positioned on said right side between four and five o'clock, and said second pocket is positioned on said left side between seven and eight o'clock.

19. The athletic pants according to claim 18, wherein said first pocket and said second pocket further comprises closure means and can be selectively opened and closed.

20. The athletic pants according to claim 19, wherein said first pocket and said second pocket further comprise vents.

* * * * *